US006939239B1

(12) United States Patent
Ash

(10) Patent No.: US 6,939,239 B1
(45) Date of Patent: Sep. 6, 2005

(54) GOLF COURSE FLAG RETENTION DEVICE

(76) Inventor: Kevin C. Ash, 307 South St., Chardon, OH (US) 44024

( * ) Notice: Subject to any disclaimer, the term of this patent is extended or adjusted under 35 U.S.C. 154(b) by 0 days.

(21) Appl. No.: 10/760,809

(22) Filed: Jan. 20, 2004

Related U.S. Application Data

(60) Provisional application No. 60/441,011, filed on Jan. 17, 2003.

(51) Int. Cl.[7] ..... A63B 57/00
(52) U.S. Cl. ..... 473/176
(58) Field of Search ..... 473/175–179

(56) References Cited

U.S. PATENT DOCUMENTS

| | | | | | |
|---|---|---|---|---|---|
| 1,041,081 | A | * | 10/1912 | Hinckley | 473/176 |
| 1,826,641 | A | * | 10/1931 | Waddell | 473/177 |
| 2,684,245 | A | * | 7/1954 | Jacoby | 473/176 |
| 3,180,644 | A | * | 4/1965 | Winquist | 473/177 |
| 3,310,026 | A | * | 3/1967 | Baird, Jr. | 116/173 |
| 3,572,707 | A | | 3/1971 | Stapleton, Jr. | |
| 3,732,845 | A | | 5/1973 | Istre | |
| 4,057,030 | A | | 11/1977 | Womack | |
| 4,095,788 | A | | 6/1978 | Benenson | |
| 4,114,879 | A | | 9/1978 | Oiler | |
| 4,273,329 | A | | 6/1981 | Trigg et al. | |
| 4,360,200 | A | * | 11/1982 | English | 473/177 |
| D320,831 | S | | 10/1991 | Stephens | |
| 5,393,053 | A | * | 2/1995 | Wiese et al. | 473/177 |
| D358,189 | S | | 5/1995 | Popowicz | |
| 5,615,635 | A | | 4/1997 | Deviney | |
| D394,295 | S | | 5/1998 | Southworth | |
| 5,857,798 | A | | 1/1999 | Flynn | |

* cited by examiner

*Primary Examiner*—Mark S. Graham
(74) *Attorney, Agent, or Firm*—Patrick J. Daugherty; Driggs, Lucas, Brubaker & Hogg Co., LPA

(57) ABSTRACT

The present invention provides for a system, method and device for attachment to a golf flagstick. Through interaction with a golf hole cup, the invention prevents indentation damage to the earthen rim of the golf hole, and abrasion damage to the flagstick itself. It also provides a means for retaining the flag in the cup, preventing high winds or other lateral pressures from unwanted removal from the cup.

20 Claims, 7 Drawing Sheets

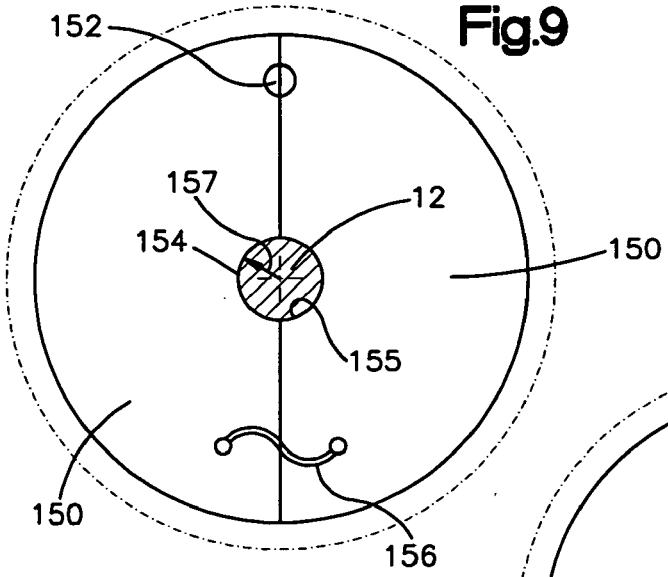
Fig.9
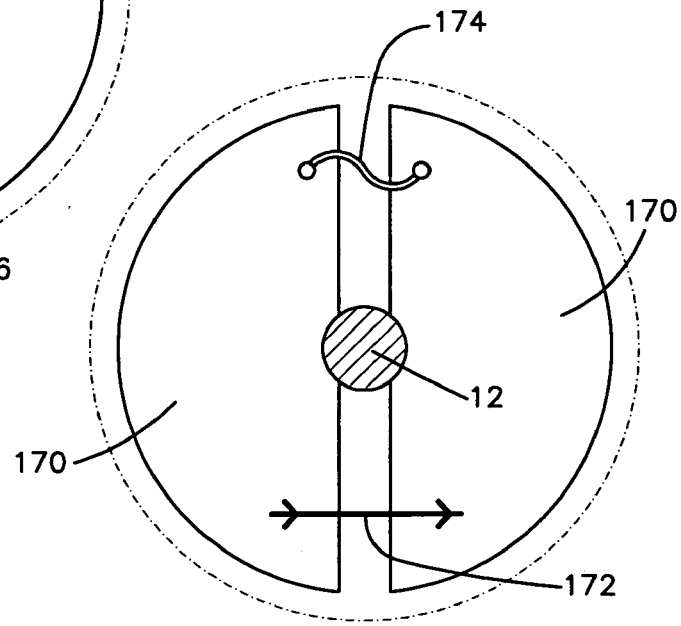
Fig.10
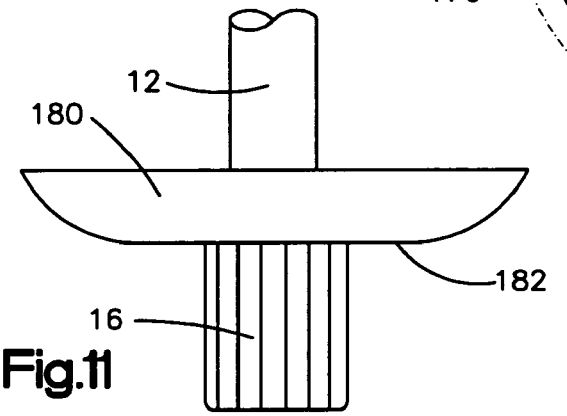
Fig.11
Fig.12
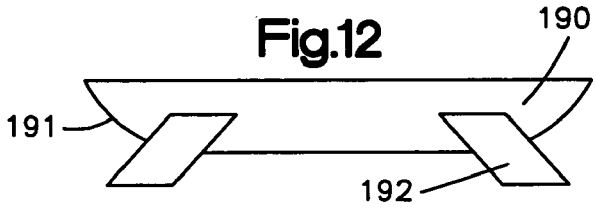
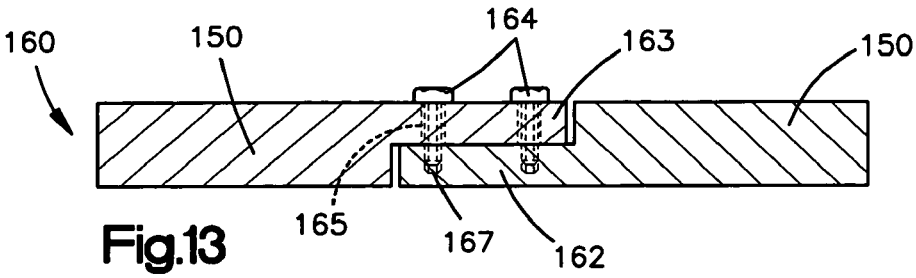
Fig.13

GOLF COURSE FLAG RETENTION DEVICE

REFERENCE TO RELATED APPLICATION

This application is a continuation-in-part of and claims the effective priority filing date of a previous provisional application filed in the United States Patent and Trademark Office by Kevin C. Ash on Jan. 17, 2003, titled "GOLF COURSE FLAG RETENTION DEVICE" and assigned Ser. No. 60/441,011.

BACKGROUND OF THE INVENTION

The present invention relates to golf course flagsticks. As is well known, a golf course flagstick is designed to be inserted into a golf course hole and stand in an upright fashion. A flag is typically attached to the top of the flagstick, and the flagstick and flag provide a visual indicator for golfers to inform them as to the exact location of the hole, and thereby provide a target for their approach shots toward the hole.

FIGS. 1 and 2 illustrate a typical United States Golf Association (USGA) approved standard golf course flag 10 inserted into a conventional USGA golf cup 20. Although USGA regulation flagsticks and hole cups are chosen to illustrate an embodiment of the present invention, it will be apparent to one skilled in the art that the present invention may be adapted for use with other non-conforming flagstick and golf hole cup assemblies. The present invention is not limited to the specific applications described herein, or to USGA-specified dimensions and materials.

A straight cylindrical fiberglass flagstick 12 has a metallic cylindrical projection "ferrule" 16 attached to its base. As also illustrated in FIG. 4, the bottom of the cup 20 has a "webbing" structure, wherein a center cylindrical aperture 22 is formed for reception of the ferrule projection 16 by web elements 27, the web elements 27 projecting from an inner cylindrical cup wall 29. In between the web elements 27, voids 25 are formed, which allow dirt and water to pass through the bottom of the cup 20, as is well known in the art. The ferrule projection 16 slides easily into and out of the cup aperture 22, enabling a golfer to easily remove or replace the flag assembly 10. The top of the flag stick 12 typically has a flexible flag 36 attached, in order to provide increased visibility of the golf flag 10.

The cup 20 is cylindrical, with an outside radius 28, and is customarily inserted into the ground G until the top rim 50 of the cup 20 is a distance 52 below the putting surface S of a golf course putting green, producing an earthen hole rim 54 at the top of the hole 11. USGA regulations specify that the distance 52 is about 1.5 inches, which is therefore also the height of earthen rim 54. The ferrule projection 16 is inserted into the cup aperture 22 until a ferrule collar 19 engages a cup aperture rim 26. When inserted into the aperture 22, ferrule projection side elements 18 engage the inside surface 24 of the aperture 22. The aperture side-wall 24 is defined about a radius 30 aligned with the cup outer radius 28. The ferrule side elements 18 are similarly defined substantially about a radius 32, which is aligned normal to the cylindrical flagstick 12 centerline C.

The ferrule side element radius is slightly smaller than the aperture radius 30, thereby enabling easy insertion and removal of the ferrule projection 16 from the aperture 22 by a golfer. By engaging the ferrule side elements 18 with the aperture side-wall 24, and the ferrule collar 19 with the cup aperture rim 26, the cup 20 holds the flagstick 12 in a vertical fashion, with the flagstick centerline C substantially normal to the cup 20 radius 28.

The flagstick 12 is typically fiberglass, with popular outside diameter dimensions of ½ or ⅝ inch. Fiberglass flagsticks 12 of these dimensions are preferred by most golf courses since they are light-weight, durable, and rigid. They are rigid enough to resist light wind pressures and remain upright, and flexible enough to progressively deflect response to progressively increasing wind pressures. Fiberglass has superior "memory" properties, and the flagstick 12 quickly returns to its upright position after the wind pressures have diminished.

It also important that the flagstick allow a golf ball to fall into the cup 20 while still inserted into the cup 20. With a typical inside diameter 40 of about 4.25 inches, a USGA cup 20 has plenty of space within the golf-ball engaging area 42 within the cup 20 to accommodate the flagstick 12 and allow a USGA regulation golf ball to fall into the cup 20.

However, the typical prior art flagstick 12, ferrule 16 and cup 20 assembly does not adequately handle strong lateral forces directed against the golf flag 36 and flagstick 12 assembly. For example, as shown in FIG. 2, strong winds cause the stick 12 to deflect laterally and contact the earthen rim 54. Strong lateral forces may also result from mishandling by golfers during insertion and removal of the flagstick 12 from the cup 20. During windy conditions, the flagstick 12 will continually strike the rim 54, which can result in severe damage to the rim 54 and, therefore, the putting surface S, such as the indentation 60 shown in FIG. 2. Moreover, when the flagstick 12 is stingily deflected by extreme lateral bending, the flagstick 12 rubs against the cup top rim 50. Repeated contact in this fashion with the rigid cup rim 50 results in accumulating abrasive damage to the flagstick 12. Circular abrasion erosion damage 62 may occur, which may encircle the flagstick 12, or more severe erosion notches 64 may form on the flagstick 12. It is readily apparent that such damage will necessitate the replacement of the flagstick 12.

Another problem caused by strong winds is that the golf flag 10 may be blown out of the cup 20 entirely. This results in damage to the putting surface S when the metal ferrule 16 falls and strikes the putting surface S with the weight of the flag 10 assembly.

What is needed is a system and method for preventing lateral forces from causing the typical golf flag flagstick to damage the golf green putting surface, or causing damage to the flagstick from striking the cup rim.

SUMMARY OF THE INVENTION

The present invention provides for a system, method and device for attachment to a golf flagstick. Through interaction with a golf hole cup, the invention prevents indentation damage to the earthen rim of the golf hole, and abrasion damage to the flagstick itself. It also provides a means for retaining the flag in the cup and preventing high winds or other lateral pressures from unwanted removal from the cup.

BRIEF DESCRIPTION OF THE DRAWINGS

FIG. 9 is a top plan view of another embodiment of the present invention, shown in relation to a conventional golf flagstick and cup.

FIG. 10 is a top plan view of another embodiment of the present invention, shown in relation to a conventional golf flagstick and cup.

FIG. 11 is a side perspective view of another device according to the present invention disposed about a conventional flagstick with ferrule.

FIG. 12 is a side perspective view of another device according to the present invention.

FIG. 13 is a side perspective sectional view of another device according to the present invention.

DESCRIPTION OF EMBODIMENTS OF THE INVENTION

The system and method according to the present invention provides for a device attached to the flagstick. Through its attachment to the flagstick and interaction with the inner walls of the golf cup, the invention prevents indentation damage to the earthen rim of the golf hole, and abrasion damage to the flagstick itself. It also provides a means for retaining the flag in the cup and preventing high winds or other lateral pressures from unwanted removal from the cup.

Figure 1:
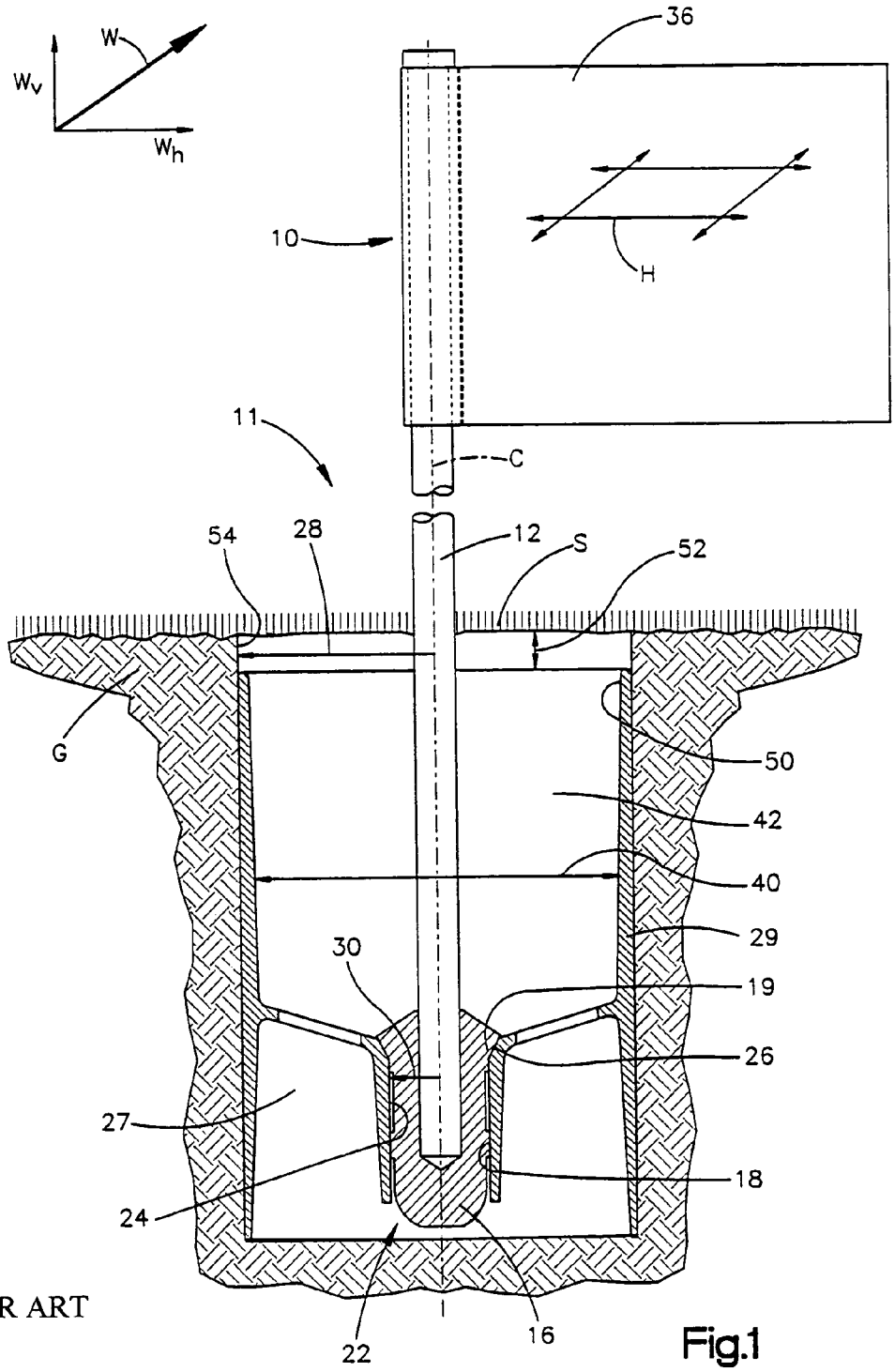
PRIOR ART Fig.1
FIG. 1 is a side perspective view of a conventional golf course flag and golf cup assembly.
Figure 2:
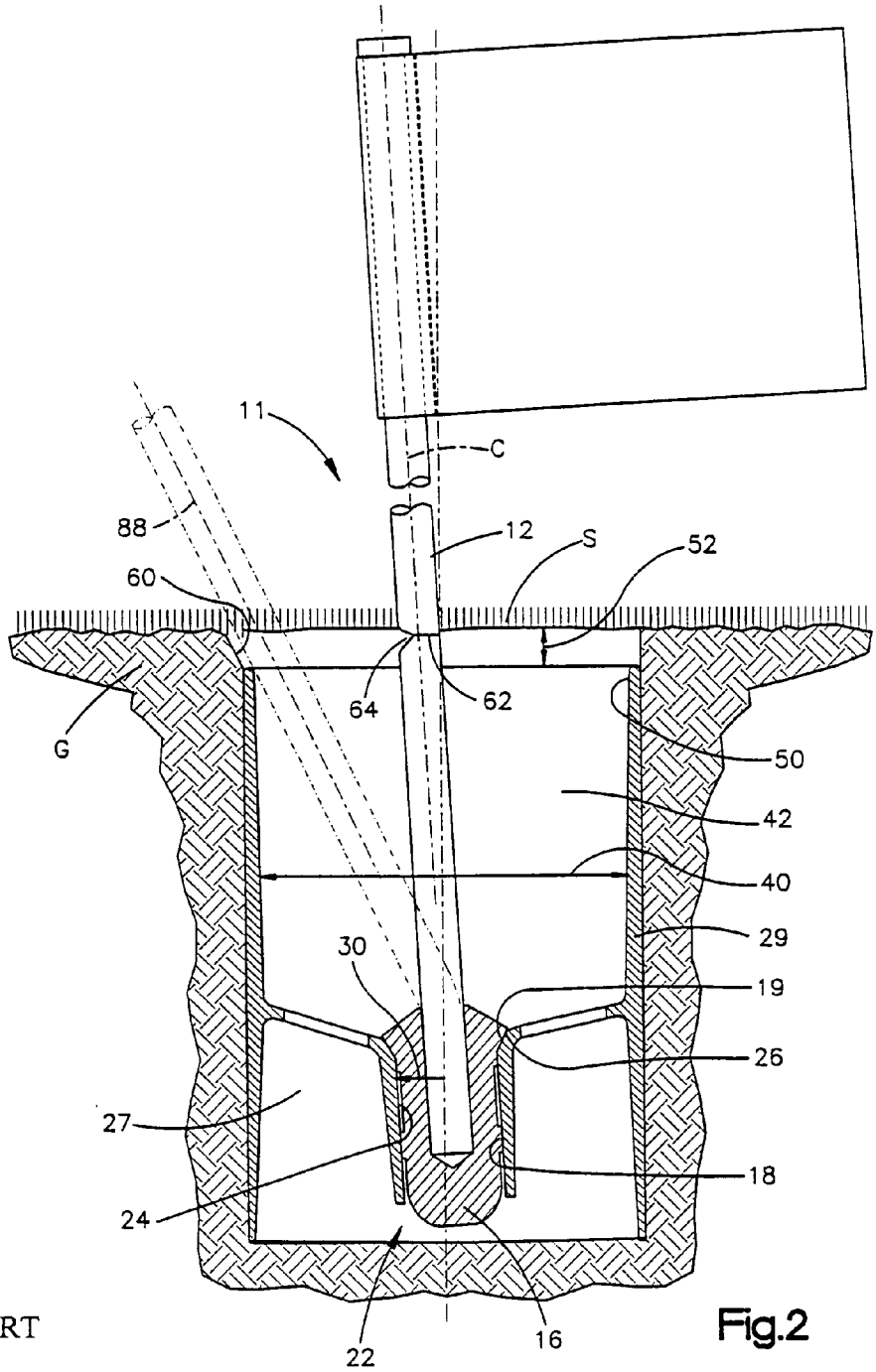
PRIOR ART Fig.2
FIG. 2 is another side perspective view of a conventional golf course flag and golf cup assembly.
Figure 3:
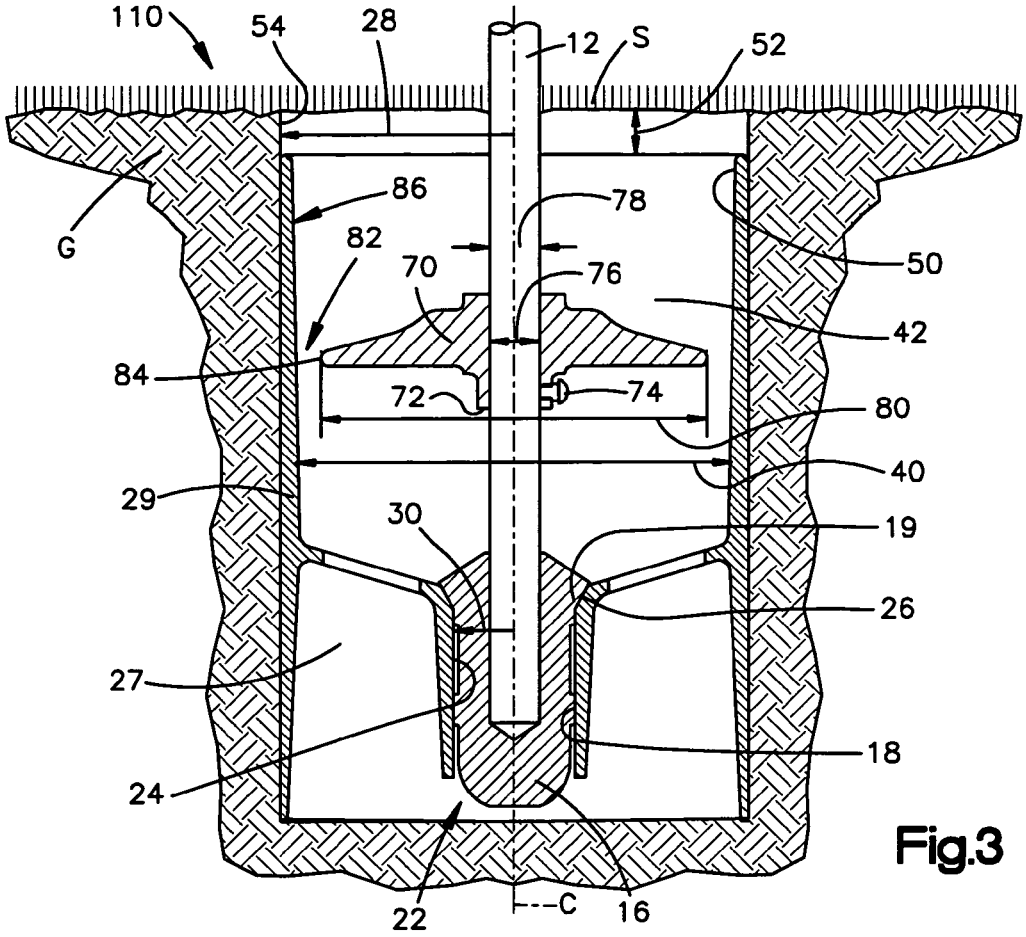
FIG. 3 is a side perspective view of a golf course flag and golf cup assembly incorporating an embodiment of the present invention.
Figure 4:
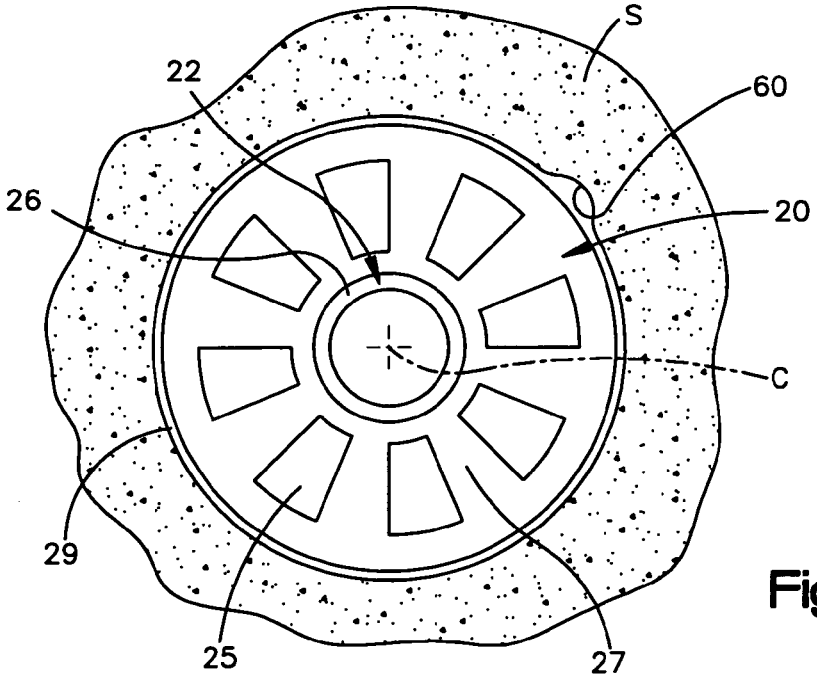
FIG. 4 is a top plan view of a conventional golf cup as installed in a conventional golf course green.

Referring now to FIG. 3, a circular disc 70 according to the present invention is provided with a circular disc aperture 72 aligned about the flagstick 12, the center of the disc 70 common with the flagstick centerline C and, therefore, defined by said centerline in FIG. 3. The disc aperture 72 has an inside diameter 76 larger than the outside diameter 78 of the flagstick 12. The disc 70 is preferably attached by removing the ferrule 16 or the flag 36 and sliding the disc 70 along the flagstick 12 to a desired position, then reattaching the ferrule 16 or flag 36. Once in position, at least one set screw 74 is tightened to keep the disc 70 in the desired position. The disc 70 may be fabricated from a variety of materials, such as ferrous or non-ferrous metals, aluminum, wood, wood by-products, rubber, or plastic materials, or from a combination of such materials.

It is important that the outside diameter dimension 80 of the disc 70 is less than the inside diameter 40 of the cup 20. This allows for easy removal or insertion of the disc 70 and flagstick 12 assembly relative to the cup 20, by providing a gap 82 between the outer disc edge 84 and the inner cup surface 86. The gap 82 also allows water, dirt and other small debris to freely fall past the disc 70 down into the cup 20. This prevents the build-up of water or debris above the disc 70, or between the disc edge 84 and the inner cup surface 86.

When the ferrule projection 16 is fully inserted into the cup aperture 22 with the ferrule projections 18 engaging the inner aperture surface 30, the flagstick 12 is held upright in a vertical fashion, with the flagstick centerline C substantially normal to the cup 20 radius 28. What is new is the interaction of the outside disc edge 84 with the inner cup surface 86. Strong winds W acting upon the golf flag assembly 110, and in particular upon the flag 36 at the top of the assembly 110, have horizontal components Wh along plane H and vertical components Wv. The horizontal components Wh acting upon the flag 36 and flagstick 12 are translated into flexing motions of the flagstick 12 along the horizontal plane H.

As the flagstick 12 flexes and moves along the horizontal plane H, the outer disc edge 84 contacts the inner cup surface 86. The disc 70 body then prevents the flagstick 12 from further deflecting horizontally, thereby preventing the flagstick 12 from coming into contact with either the earthen hole rim 54 or the upper cup rim 50. Therefore, the disc 70 prevents both flagstick damage to the earthen hole rim 54, and damage to the flagstick 12 from abrasive contact with the cup rim 50.

The disc 70 also helps retain the flag assembly 10 within the cup 20 during high winds. Wind pressures W may be strong enough to compel a prior art flagstick assembly 10 upwards enough to remove the ferrule projection 16 out of the cup aperture 22. This may result in the flagstick 12 falling against the earthen rim 54 or the cup rim 50, or both. Damage may then result to the earthen rim 54 or flagstick 12, or both, as described above. Or the prior art flagstick assembly 10 may be compelled upward entirely out of the cup 20, causing the ferrule projection 16 to fall and strike the putting surface S, thereby indenting or otherwise damaging the putting surface S. What is new in the present invention is that the disc 70 prevents either event from occurring.

As discussed above, winds W strong enough to compel the ferrule 16 or the entire prior art flagstick assembly 10 out of a cup 20 have horizontal components Wh along the horizontal plane H. These horizontal components Wh cause the flagstick 12 to flex horizontally along the horizontal plane H until the disc edge 84 contacts the inner cup surface 86. Frictional forces now must be overcome at the engagement of the disc edge 84 with the inner cup surface 86 before the disc edge 84 can be compelled to slide upward along the contacted cup surface 86, which must occur for the flag assembly 110 to move upward with respect to the cup 20. As is readily apparent, the stronger the horizontal wind components Wh, the greater the force with which the disc edge 84 is driven into the inner cup surface 86 and, correspondingly, the greater the frictional resistance to upward movement provided by disc edge 84.

The disc edge 84 may be a hard smooth surface, such as metal or a hard plastic, or it may be selected to increase the frictional forces generated in the engagement of the golf cup inner wall surface 86; for example, the disc edge 84 may be a soft rubber compound, or have a tacky compound disposed along the surface, providing increased frictional characteristics. Similarly, a resilient rubber or plastic material may deform or flow, or both, thereby increasing the edge 84 surface area actually engaging the inner cup surface 86.

Additionally, the disc edge 84 also serves as a fulcrum for forces in excess of those necessary to deflect the flagstick 12 to bring it into contact with the inner cup surface 86. The horizontal wind components Wh in excess of forces Fd required to deflect the flagstick 12 and bring the disc edge 84 into contact with the inner cup surface 86 will translate through the disc edge 84 as fulcrum through the disc 70, flagstick 12 and ferrule 16 as additional cup aperture engaging forces Fc. The forces Fc urging the ferrule 16 into the inner aperture surface 30 produce additional frictional forces that must be overcome to slide the ferrule 16 out of the aperture 20.

The present invention may also help retain a flagstick assembly within a cup by providing additional weight that must be overcome to lift the flagstick assembly out. For example, weight can be increased by fabricating the disc 70 out of dense metallic compounds, or by filling a hollow lighter weight plastic body with a heavy ballast material.

Figure 5:
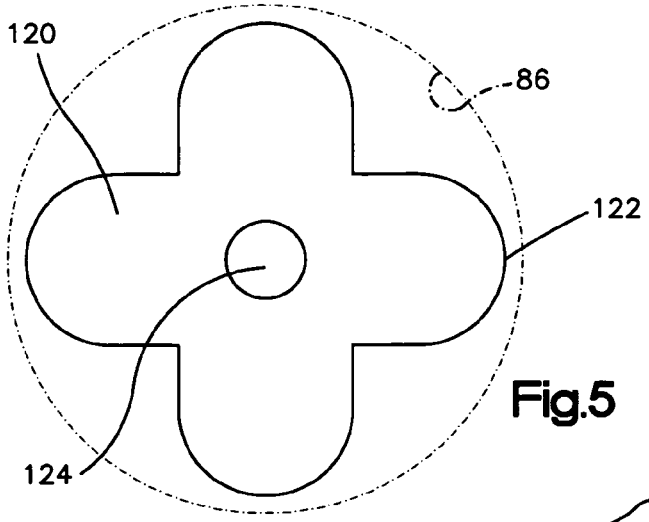
FIG. 5 is a top plan view of a clover-leaf device according to the present invention, shown in relation to a conventional golf cup.
Figure 7:
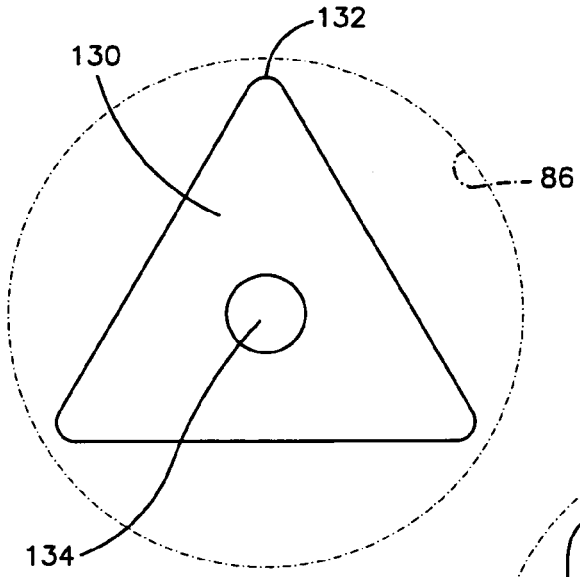
FIG. 7 is a top plan view of a generally triangular device according to the present invention, shown in relation to a conventional golf cup.
Figure 8:
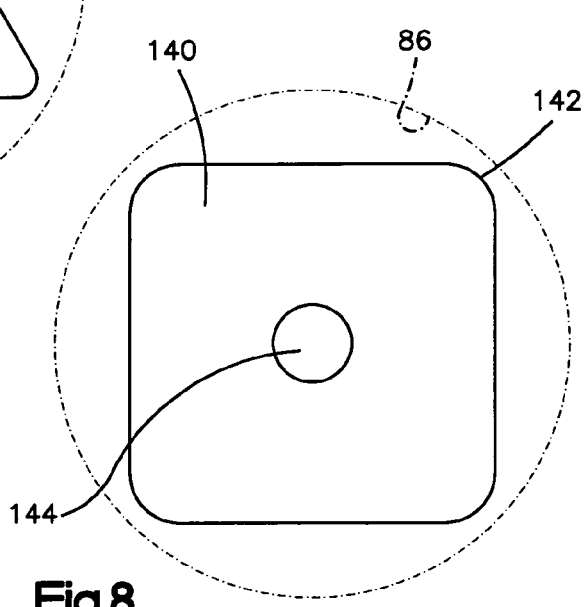
FIG. 8 is a top plan view of a generally rectangular embodiment of the present invention, shown in relation to a conventional golf cup.

The present invention may be practiced in a wide variety of shapes, and be fabricated out of a wide variety of materials. For example, FIG. 5 shows a top plan view of a clover-leaf device 120 according to the present invention with four cup engaging edges 122 arrayed about a center aperture 124 formed to fit around a flagstick. FIG. 7 shows a top plan view of a triangular device 130 according to the present invention with three cup engaging regions 132 arrayed about a center aperture 134 formed to fit around a flagstick. And FIG. 8 shows a rectangular device 140 according to the present invention with four cup engaging regions 142 arrayed about a center aperture 144 formed to fit around a flagstick. The shape of a cup retaining device according to the present invention is not important; what is important is that a substantial singular or plurality of cup-engaging edges are provided to engage the inner cup surfaces 86 when a flagstick is deflected laterally in the horizontal plane. The larger the number of engagement regions, or larger the total surface area of the engaging region or regions, the more likely a device engagement region will engage the inner surface of the cup responsive to lateral deflections. Conversely, one may make removal of the present invention from a cup easier for a golfer by reducing the number and contact area, or both, of the engaging edges, thereby lessening engagement friction forces from incidental cup surface contact while the assembly is being removed. However, reducing the number and area, or both, of the engaging edges will reduce the wind force resistance qualities of the present invention.

Figure 6:
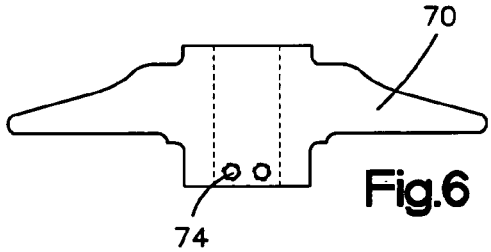
FIG. 6 a side perspective view of the embodiment of the present invention of shown in FIG. 3.

The present invention may attach to a flagstick through a variety of means. For example, FIG. 6 shows the disc 70 with two set-screws 74 for frictional and compressive interaction with a flagstick. FIG. 9 is a top plan view of another embodiment of the present invention, wherein two flat circular disc halves 150 are joined at a top point by a hinge means 152. Examples of suitable hinge means 152 are a metallic hinge assembly, or an elastic and resilient rubber band. Other appropriate hinge means 152 embodiments will be readily apparent to one skilled in the art. Each disc half 150 forms a semi-circular notch 154. The disc halves 150 are attached to a flagstick 12 by clamping the semi-circular notches 154 about the flagstick 12 and locking the halves 150 in place with a locking means 156. Examples of suitable locking means 156 are a metallic hook-and-latch assembly, or an elastic and resilient rubber band and hook assembly. Other appropriate locking means 156 embodiments will be readily apparent to one skilled in the art. The semi-circular notches 154 each have a radius 157 less than or equal the radius of the flagstick 12, in order to enable the disc halves 150 to clamp onto the flagstick 12. It is preferred that the inner surfaces 155 of the notches 154 are formed from a resilient material, in order to better "clamp" onto the flagstick 12 and hold the disc halves 150 fixed in position.

FIG. 13 depicts another means 160 for locking the disc halves 150 together. Overlapping lips 162 and 163 are brought together. Locking screws 164 pass through apertures 165 in upper lip 163 and into threaded screw holes 167 in lower lip 162.

FIG. 10 shows another embodiment of the present invention. Resilient compressible circular disc halves 170 without center voids or notches are attached by a hinge means 172 and locked into compressive relation about a flagstick 12 with locking means 174.

FIG. 11 shows a cup-shaped conical embodiment 180 of the present invention. The bottom surface 182 is shaped to follow the contours of the inner surface of the bottom of a USGA cup 20, or any other desired golf cup. The conical embodiment 180 is attached to a flagstick 12 at a point aligning the bottom surface 182 with the top of the ferrule 16, thereby enabling the bottom surface 182 to engage the cup inner surface when inserted within the cup.

FIG. 12 shows another cup-shaped conical embodiment 190 of the present invention. The bottom surface 191 is shaped to follow the contours of the inner surface of the bottom of a USGA cup 20, or any other desired golf cup. Fins 192 are projected from the bottom surface 191 for insertion into cup webbing voids. In the example shown in FIG. 16, the fins 192 are formed for cooperative insertion into standard USGA cup web voids 25. The fins 192 engage the cup web elements 27 and thereby help secure a flag assembly (not shown) incorporating the embodiment 190 in a vertical alignment in resistance to horizontal wind components.

Figure 14:
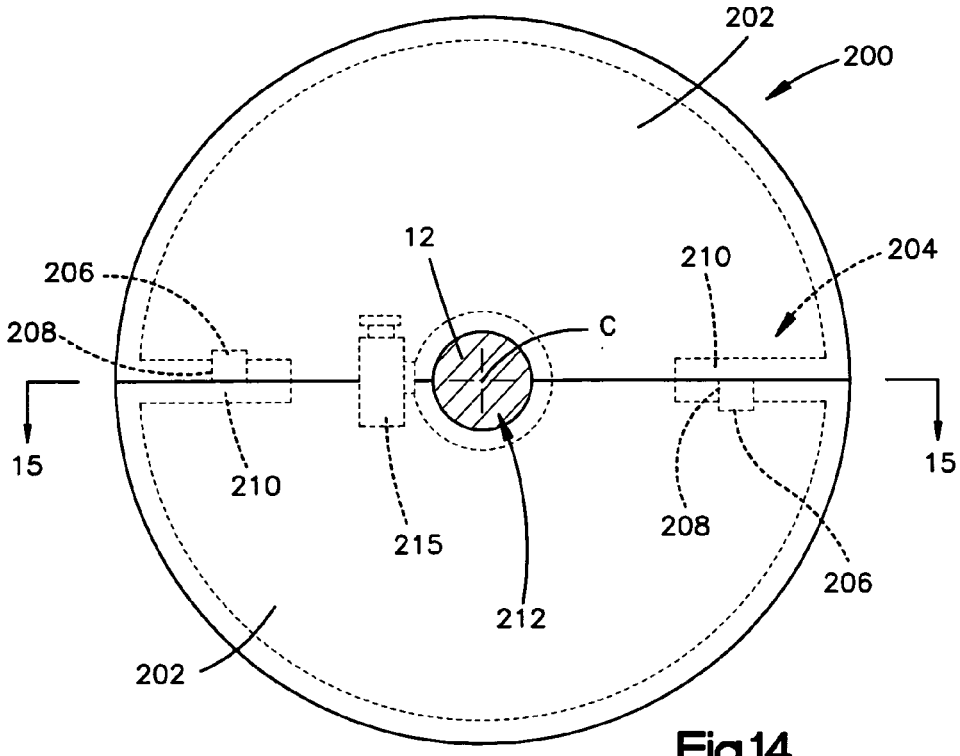
FIG. 14 is a top plan view of another embodiment of the present invention, shown in relation to a conventional golf flagstick.
Figure 15:
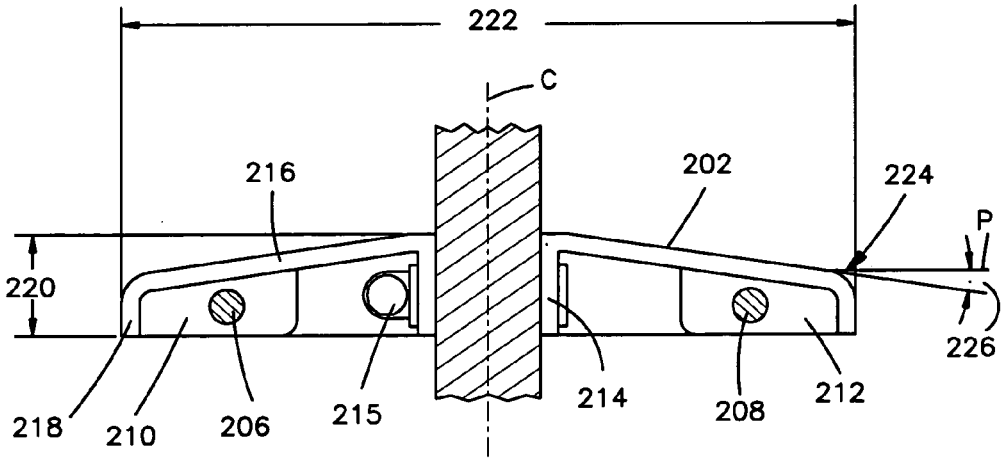
FIG. 15 is a side sectional view of the embodiment and flagstick of FIG. 14.

FIG. 14 is a top plan view of another embodiment 200 of the present invention. FIG. 15 is a sectional view of the embodiment 200 of FIG. 14. Two semi-circular discs 202 defined about a centerline C are provided for connecting to each other by a plug-and-hole means 204 to form the assembly 200. A projecting plug 206 is formed on a male mounting flange 210, and an aperture 208 for receiving a plug 206 is defined by a female mounting flange 212. The disc 202 defines a semi-circular aperture 212 about the centerline C for receiving a typical golf flagstick shaft 12. By aligning the shaft apertures 212 about a flagstick shaft 12 and pressing each plug 206 into a corresponding aperture 208, two semi-circular discs 202 can be connected together to form an assembly 200 about a typical golf flag shaft 12.

The discs 202 may be attached to the flagstick shaft 12 by clamping the shaft aperture side-walls 214 against the shaft 12 with a typical band clamp 215. The band clamp 215 also functions to keep the semi-circular discs 202 together to thereby form the assembly 200. Disc top wall members 216 radiate outward and bend downwards to form outside edge walls 218. The outside edge walls 218 are formed to engage golf hole cup inner walls 29 to prevent damage to the flagstick 12, as described generally above in the description of other embodiments. It is preferred that the aperture side-walls 214 are formed from a resilient material, in order to better "clamp" onto the flagstick 12 and hold the disc halves 202 fixed in position.

Figure 17:
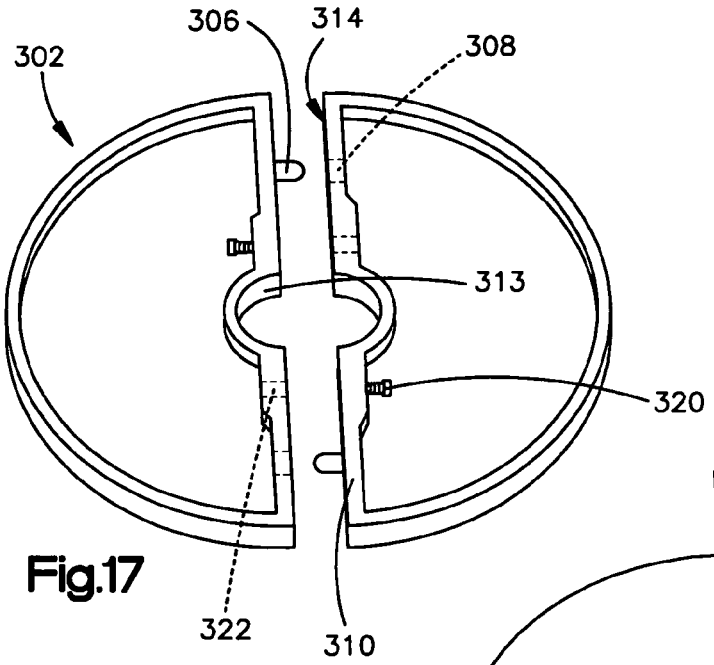
FIG. 17 is a bottom plan view of the embodiment of FIG. 16.
Figure 18:
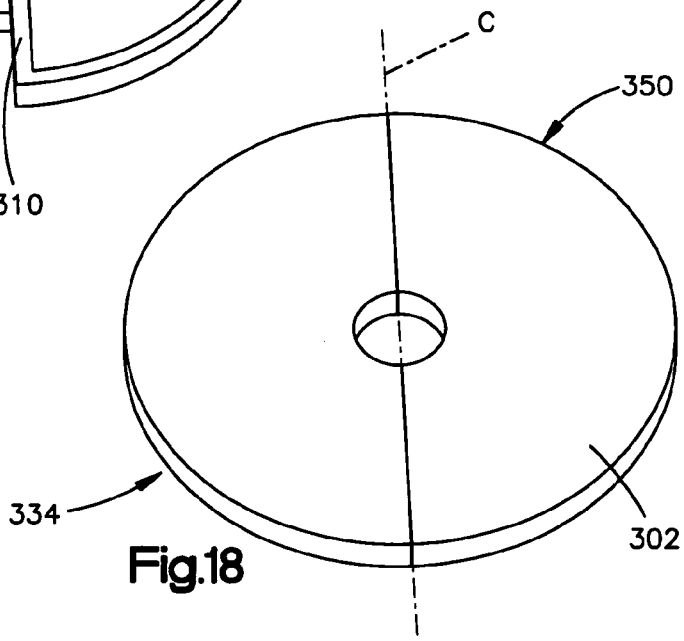
FIG. 18 is another top plan view of the embodiment of FIGS. 16 and 17.

In one embodiment of the invention illustrated in FIGS. 17 and 18, the disc 202 is formed from a resilient plastic material with good memory characteristics, such as ABS or high-impact polypropylene, with walls 214, 216 and 218 having a thickness of about 0.125 inch. The disc 202 has a height dimension 220 of about 0.55 inch, and a width 222 of about 3.9 inches. Outside edge walls 218 are chamfered downward from the top disc wall 216 at a chamfer radius 224 of about 3/16 inch, the outside edge walls 218 aligned about parallel with the centerline C. The plug 206 preferably has an outside dimensional radius of about 3/16 inch, and the plug aperture 208 preferably has an inside dimensional radius of about 3/16 inch.

The top disc wall 216 is disposed downward from the aperture side-walls 214 at an angle 226 of about 7.50 degrees with a plane P normal to the centerline C. This downward angle 226, as well as the downward angle orientations of other embodiments of the present invention, enables a golf ball falling into a golf cup to bounce off of the disc 202 with a sideways orientation into the side of the cup, rather than straight up. In this fashion, by aligning the top surface of the present invention at a sufficient distance below the rim of the golf cup, a ball dropping into the cup will not bounce off of the invention top surface and out of the cup; it will instead settle into the cup after bouncing between the invention top surface and the sidewalls of the cup, thus enabling retention of the ball within the cup. Exemplary distances from the top of the cup are about 1.75 inches, about three inches and about four inches, but other values may also be used. This is an important feature for the utilization of the present invention on a golf course. The location of various embodiments of the present invention along a golf flagstick may be varied to increase the distance between the invention and the top of the golf cup to thereby improve this behavior. Alternatively, embodiments of the present invention may be aligned relatively close to the upper rim of the golf cup rim, in order to prevent a golf ball from dropping into the hole. This alignment would be useful for putting or other practice activities.

Figure 16:
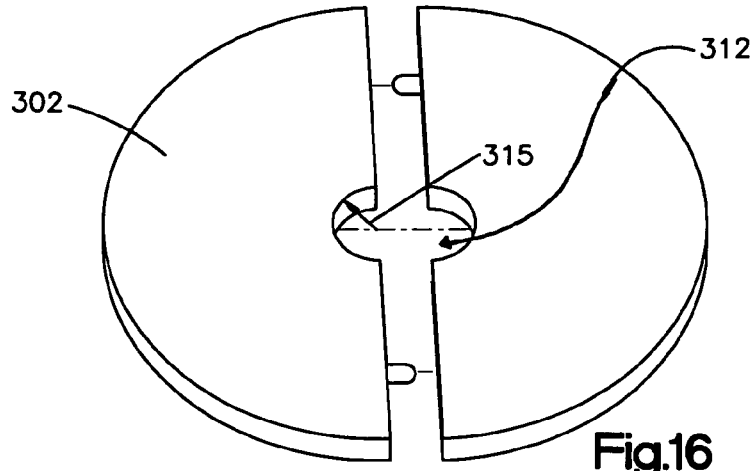
FIG. 16 a top plan view of another embodiment of the present invention.

FIGS. 16 through 18 illustrate another embodiment of the present invention. A semi-circular disc 302 defines a semi-circular aperture 312 about a common centerline C for receiving a typical golf flagstick shaft, wherein the centerline of the golf flagstick is intended to align with the common centerline C when two of the discs 302 are joined in an assembly 350 about the flagstick. It is preferable that an inner cylindrical surface 313 further defining each aperture 312 firmly engage the outer surface of a flagstick workpiece when two discs 302 are brought together about the flagstick to form the composite assembly 350. It is preferable to select the aperture inner surface 313 radius 315 as a value less than the outer radius of the flagstick and form the disc aperture inner surface 313 from a resilient material with good memory characteristics which will be compressed by engagement with the flagstick, the aperture inner surface 313 thereby providing corresponding expansion forces resistive to its compression and against the flagstick outer surface, so that the assembly 350 tightly grips the flagstick and remains in a fixed position along the length of the flagstick. Preferred disc 302 and/or aperture inner surface 313 materials include resilient plastics, such as ABS or high-impact polypropylene; however, other materials (such as wood, rubber, or metal) may also be utilized, and the present invention is not limited to resilient plastics.

The aperture inner surface 313 may be smooth, or it may be knurled and formed with some other irregular or rough surface shape to improve the gripping abilities of the aperture inner surface 313.

A mating flange 310 is provided, with a planar mating surface 314 configured to mate with a mating surface 314 of a second disc 302 in the assembly 350 about a flagstick. The planar mating surface 314 is preferably aligned with the common centerline C. A plug 306 projects generally normal the mating surface 314. A plug receiving aperture 308 is defined by the mating flange 310 and aligned to receive the plug 306 of a second disc 302 when aligned into the composite structure 350. The assembly 350 is held together through the use of a screw 320 disposed through the mating flange 310 of each disc 302. Each disc screw 320 engages a corresponding threaded screw aperture 322 on the other disc 302. By using at least two screws 320 and locating one on each side of the semi-circular apertures 312, the two discs 302 are brought into compressive contact with a flagstick located within the apertures 312 in the composite structure 350, as described above.

The present embodiment has a smooth cylindrical outer cup wall engagement edge surface 334 for engagement with the inner surface of the golf cup according to the present invention, as described above and claimed herein. However, other engagement surface 334 finishes (e.g. knurled, irregular, rough surfaces) may be used to increase or decrease the frictional interaction with a golf cup inner wall surface. Similarly, other engagement surface 334 shapes (e.g. linear, irregular) may be practiced to increase or decrease the golf cup inner wall surface areas engaged to further alter the interactions of the engagement surface 334 with the golf cup inner wall surface.

While preferred embodiments of the invention have been described herein, variations in the design may be made, and such variations may be apparent to those skilled in the art of making articles of manufacture, as well as to those skilled in other arts. The materials identified above are by no means the only materials suitable for the manufacture of the invention, and substitute materials will be readily apparent to one skilled in the art. The scope of the invention, therefore, is only to be limited by the following claims.

What is claimed is:

1. A protective apparatus for attachment to a golf flagstick, comprising:

a substantially rigid generally circular body encompassing a golf flagstick and attached to the flagstick through a means for attachment, the circular body formed by joining first and second substantially rigid generally semicircular bodies about the flagstick;

the first and second semicircular bodies each having a semicircular outside edge defining a composite generally circular outside edge disposed about the flagstick at a point along the length of the flagstick chosen to align the composite outside edge with an inner surface of a cylindrical golf-hole cup when the flagstick is positioned within the golf-hole cup, said composite outside edge having an edge radius less than an inner surface radius of the golf-hole cup;

the first semicircular body having a first semicircular upper rim and the second semicircular body having a second semicircular upper rim, the first and second semicircular upper rims defining a composite protective structure circular upper rim, the composite upper rim defining a circular flagstick aperture about the flagstick;

the first and second semicircular bodies each having a semi-conical downwardly oriented upper surface for defining a composite protective structure top surface having a generally downward conical shape defined between the composite upper rim and the composite circular outside edge, with the composite upper rim located higher along the flagstick relative to the outside edge; and a means for connecting the first semicircular body to the second semicircular body;

wherein flexion of the flagstick positioned within the golf-hole cup generally horizontally causes contact of the composite outside edge with the golf-hole cup, said protective structure thereby preventing further deflection of the flagstick into contact with the golf-hole cup or a rim of a putting surface encompassing the golf-hole cup and disposed above an upper rim of the golf-hole cup.

2. The protective apparatus of claim 1 wherein the composite outside edge is configured to forms a frictional engagement with the golf-hole cup inner surface in opposition to upward vertical forces.

3. The protective apparatus of claim 2 wherein the composite outside edge is a cylindrical surface aligned generally parallel to the golf-hole cup inner surface.

4. The protective apparatus of claim 1 wherein the downward conical shape of the top surface of the protective structure defines an angle from normal to the flagstick, the angle having a value of at least 7.5 degrees.

5. The protective apparatus of claim 4 wherein the protective structure is attached at an attachment point along the flagstick so that the protective structure top surface is positioned below a golf-hole cup upper rim a depth dimension of at least about 1.75 inches.

6. The protective apparatus of claim 3 wherein the circular body is configured to function as a fulcrum when the composite outside edge is in contact with the golf-hole cup inner surface and thereby translate forces acting generally horizontally upon the flagstick into generally opposite horizontal forces exerted by a base area of the flagstick against the golf-hole cup, the base area located below the circular body.

7. The protective apparatus of claim 3 wherein the first and second semicircular bodies are formed from a resilient plastic material.

8. The protective apparatus of claim 7, wherein the first and second semi-conical top surfaces and semicircular outside edges have a thickness of about 0.125 inches; and the composite protective structure has a height dimension of about 0.55 inches and a width dimension of about 3.9 inches.

9. A protective apparatus for attachment to a golf flagstick, comprising:

a generally circular body encompassing a golf flagstick and attached to the flagstick through a means for attachment, the circular body formed by joining first and second generally semicircular bodies about tie flagstick;

the first and second semicircular bodies each having a semicircular outside edge, the circular body thereby defining a composite generally circular outside edge disposed about the flagstick at a point along the length of the flagstick chosen to align the circular outside edge with an inner surface of a cylindrical golf-hole cup when the flagstick is positioned within the golf-hole cup, said circular outside edge having an edge radius less than an inner surface radius of the golf-hole cup;

the first semicircular body having a first semicircular upper rim and the second semicircular body having a second semicircular upper rim, the first and second semicircular upper rims defining a composite protective structure circular upper rim; and the first semicircular outside edge defined from a first planar mating flange and the second semicircular outside edge defined from a second planar mating flange, each of the first and second mating flanges configured to mate with the other of the first and second mating flanges;

the first and second semicircular bodies each having a semi-conical downwardly oriented upper surface for forming the protective structure top surface, the circular protective body thereby defining a composite protective structure top surface having a generally downward conical shape defined between the composite upper rim and the composite circular outside edge, the composite upper rim located higher along the flagstick relative to the outside edge;

the first and second semicircular bodies each having a semicircular upper rim, the circular protective body thereby defining a composite protective structure upper rim the composite upper rim defining a circular flagstick aperture about the flagstick;

each of the first and second mating flanges having a plug projecting generally normal therefrom;

each of the first and second mating flanges defining a plug receiving aperture for receiving the plug of the other of the first and second mating flanges; and a means for connecting the first semicircular body to the second semicircular body.

10. The protective apparatus of claim 1 wherein the means for attachment comprises a first semi-cylindrical flange extending from the first semicircular upper rim generally parallel to a central axis common with the flagstick, the first semi-cylindrical flange brought into contact with the flagstick; and a second semi-cylindrical flange extending from the second semicircular upper rim generally parallel to a central axis common with the flagstick, the second semi-cylindrical flange brought into contact with the flagstick.

11. The protective apparatus of claim 10 wherein the means for attachment further comprises a set screw in at least one of the first and second semi-cylindrical flanges for exerting compressive force against the flagstick and thereby holding the protective structure in a fixed position along the flagstick.

12. The protective apparatus of claim 10 wherein the first and second semi-cylindrical flanges have a common radius less than the outer radius of the flagstick, wherein connecting the first semicircular body to the second semicircular body through the means for connecting causes the first and second semi-cylindrical flanges to exert compressive force against the flagstick and thereby holding the protective structure in a fixed position along the flagstick.

13. The protective apparatus of claim 10 wherein the means for attachment further comprises a clamping means disposed about the first and second semi-cylindrical flanges for clamping the first and second semi-cylindrical flanges against the flagstick and thereby holding the protective structure in a fixed position along the flagstick.

14. A method for protecting a golf flagstick from damaging contact with a cylindrical golf-hole cup or a rim of a putting surface encompassing the golf-hole cup and disposed above an upper rim of the golf-hole cup, comprising the steps of:

providing structurally rigid first and second semi-conical bodies, the first send-conical body defining a first semi-conical top surface between a first semi-circular upper rim and a first lower semicircular outside edge, the second semi-conical body defining a second semi-conical top surface between a second semi-circular upper rim and a second lower semicircular outside edge, the first and second outside edges having an edge radius less than an inner surface radius of the golf-hole cup;

aligning the first and second semi-conical bodies about the flagstick at a point along the length of the flagstick chosen to align the first and second semicircular outside edges along an inner surface of a cylindrical golf-hole cup when the flagstick is positioned within the golf-hole cup;

attaching the first and second semi-conical bodies to each other about the flagstick, the first and second semicircular outside edges thereby forming a composite circular outside edge, the first and second semi-circular upper rims thereby forming an upper composite rim defining a circular flagstick aperture about the flagstick, the first and second semi-conical top surfaces defining a generally downward composite conical top surface defined between the upper composite rim and the circular outside edge, the upper composite rim located higher along the flagstick relative to the composite circular outside edge;

attaching the first and second semi-conical bodies to the golf flagstick through a means for attachment;

inserting the golf flagstick and protective structure in the golf-hole cup; and the composite generally circular outside edge contacting the golf-hole cup responsive to flexing of the flagstick generally horizontally, the composite protective structure thereby preventing further deflection of the flagstick into contact with the golf-hole cup or a rim of a putting surface encompassing the golf-hole cup and disposed above an upper rim of the golf-hole cup.

15. The method of claim 14, further comprising the step of:

configuring the composite generally circular outside edge to form a frictional engagement with the golf-hole cup inner surface responsive to the step of contacting the golf-hole cup;

the frictional engagement proving fictional retaining forces in opposition to upward vertical forces; and the functional retaining forces holding the protective structure and the golf flagstick within the golf-hole cup in opposition to upward vertical forces.

16. The method of claim 14 wherein the composite protective structure is configured to function as a fulcrum when the outside edge in is contact with the golf-hole cup, further comprising the steps of:

the protective structure translating generally horizontal forces acting upon the flagstick and aligned with flexion forces bringing the circular outside edge in contact with the golf-hole cup into generally opposite horizontal forces exerted by a base area of the flagstick against the golf-hole cup, the base area located below the protective structure.

17. The method of claim 16, further comprising the steps of:

the base of the flagstick forming a base frictional engagement with the golf-hole cup responsive to the step of translating forces; and the base frictional engagement providing basal frictional retaining forces holding the base of the golf flagstick within the golf-hole cup in opposition to upward vertical forces.

18. The method of claim 14 wherein the composite outside edge further defines a cylindrical surface aligned generally parallel to the golf-hole cup inner surface.

19. The method of claim 14, further comprising the step of forming the first and second semi-conical bodies wherein the composite downward conical shape defines an angle from normal to the flagstick, the angle chosen wherein a falling golf ball striking the top surface of the protective structure will bounce with a horizontal orientation toward and against the inner surface of the golf-hole cup.

20. The method of claim 19 wherein the angle has a value of at least 7.5 degrees.

* * * * *